US009452910B2

(12) United States Patent
Huehn

(10) Patent No.: US 9,452,910 B2
(45) Date of Patent: Sep. 27, 2016

(54) LANYARD ASSEMBLY FOR LIFTING A RESCUE APPARATUS

(71) Applicant: IVECO MAGIRUS AG, Ulm (DE)

(72) Inventor: Alexander Huehn, Ulm (DE)

(73) Assignee: IVECO MAGIRUS AG, Ulm (DE)

( * ) Notice: Subject to any disclaimer, the term of this patent is extended or adjusted under 35 U.S.C. 154(b) by 0 days.

(21) Appl. No.: 14/976,205

(22) Filed: Dec. 21, 2015

(65) Prior Publication Data

US 2016/0176683 A1 Jun. 23, 2016

(30) Foreign Application Priority Data

Dec. 23, 2014 (EP) ..... 14200259

(51) Int. Cl.
*B66C 1/16* (2006.01)
*A62B 1/16* (2006.01)
*A62B 35/00* (2006.01)

(52) U.S. Cl.
CPC . *B66C 1/16* (2013.01); *A62B 1/16* (2013.01); *A62B 35/0075* (2013.01)

(58) Field of Classification Search
CPC ..... B66C 1/12; B66C 1/14; B66C 1/16; F16G 11/14; A62B 1/16; A62B 35/0075
USPC ..... 294/74
See application file for complete search history.

(56) References Cited

U.S. PATENT DOCUMENTS 2,412,895 A 12/1946 Lewis
3,046,045 A * 7/1962 Campbell ..... B66C 1/12 182/1
3,718,945 A * 3/1973 Brindejonc de Treglode ..... B29C 47/027 24/370
4,673,059 A 6/1987 Kurtgis
4,850,629 A * 7/1989 St. Germain ..... B66C 1/12 294/74
5,417,304 A 5/1995 Kurtgis
5,727,833 A * 3/1998 Coe ..... D07B 1/18 294/74
6,533,066 B1 3/2003 O'Dell
7,278,670 B2 * 10/2007 Galletta ..... B66C 1/20 294/74
8,544,912 B1 * 10/2013 Matthews ..... B66C 1/12 294/74

FOREIGN PATENT DOCUMENTS

DE 202009009318 U1 9/2009

OTHER PUBLICATIONS

European Search Report for EP Application No. EP14 20 0259 dated Jul. 7, 2015, 4 pages.

* cited by examiner

*Primary Examiner* — Dean Kramer
(74) *Attorney, Agent, or Firm* — Remarck Law Group PLC

(57) ABSTRACT

A lanyard assembly for lifting a rescue stretcher, includes a lifting gear with a lower fastening arrangement to be fixed at different fastening points of the stretcher, and a rope assembly to connect the lifting gear with a lifting device, wherein the rope assembly includes a set of rope sections, each rope section having a fixed length and a first end being connectable to the lifting device and an opposite second end being connectable to the first end of any other rope section or to the lifting gear.

4 Claims, 3 Drawing Sheets

LANYARD ASSEMBLY FOR LIFTING A RESCUE APPARATUS

CROSS REFERENCE TO RELATED APPLICATIONS

This application claims priority to European Patent Application No. 14200259.1 filed on Dec. 23, 2014, the entire disclosure of which is incorporated herein by reference.

The present invention relates to a lanyard assembly for lifting a rescue apparatus, in particular a rescue stretcher, according to the preamble of claim 1.

BACKGROUND OF THE INVENTION

For attaching a rescue stretcher to a lifting device, for example, to the tip of a turnable ladder of a fire fighting vehicle or to another kind of aerial lifting apparatus, lanyard assemblies are known that comprise a plurality of attachment elements. Typically the lanyard assembly comprises a lifting gear that is attached directly to the stretcher and comprises suitable fastening means, for example, carabiners to be engaged into different points at the rim of the rescue stretcher. For adapting the length of the lanyard assembly to the present rescue situation, a rope assembly is provided to connect the upper end of the lifting gear with the lifting device. The same arrangement can be used to any other kind of rescue apparatus, like a harness for lifting a person, for example. Just for the sake of simplicity, the following description only refers to rescue stretchers of the basket type, which shall not be understood as limiting the invention. It is noted here that the term "rope" shall not be understood here as limiting to any certain kind of material, including different kinds of long, stringy and/or fibrous materials of any kind of cross-section (flat, round, etc.) and any kind of natural or synthetic material and having a suitable tension strength for the purpose to which the present invention refers.

In a common embodiment, the rope assembly comprises two independent ropes guided in parallel, with their upper ends to be connected to the lifting device, and their lower ends being connectable to the lifting gear. The use of two ropes provides a redundancy in bearing the load, because each rope can take the load for its own in case of failure of the other one. The length of both ropes must be adapted such that during normal use, the load is distributed in equal shares to both ropes. Their length is often fixed simply by knotting each rope to shorten it. However, this simple technique often leads to the result that the ropes do not have exactly the same length, and the load is not equally shared between them. This problem occurs even more often when the whole assembly must be fixed under time pressure, typically in a rescue situation.

SUMMARY OF THE INVENTION

It is therefore an object of the present invention to provide a lanyard assembly of the above kind that enables the fail-safe mounting and connection of all necessary parts in short time, including an easy and safe adaption of the length of the rope assembly.

This object is achieved by a lanyard assembly comprising the features of claim 1.

According to the present invention, the rope assembly comprises a set of rope sections connected serially to one another. Each rope section within this set has a fixed length. All rope sections have a first end, which is the upper end in the hanging position of use of the lanyard assembly, which is connectable to the lifting device. The opposite second end (or lower end) is connectable to the first end of any other rope section, or to the lifting gear. Each rope section comprises at least two rope strings guided in parallel within the respective rope section between its first and second end, to provide the necessary redundancy in taking the load, as described above.

From this set of rope sections, different sections of suitable length can be selected and connected to one another serially with their first and second ends, to form one rope of different sections, which is connected to the lifting device with its upper end (i. e. the first end of the upper most rope section) and to the rescue apparatus with the second end (lower end) of the bottom rope section. Within this arrangement, it is possible to exchange the rope sections against each other to change their order. In fact there is no defined order of rope sections to be fixed to one another, because all first ends and second ends of all rope sections within the set are compatible with each other, i. e. each first end is connectable to each second end. This facilitates the choice of rope sections to be used in a rescue situation to form a rope connection between the lifting gear and the stretcher with a desired length. Moreover, the connection mechanisms at the respective first ends and second ends can be made simple and easy to use, saving valuable time. Because the length of the rope sections is fixed, no length adjustment like knotting the ropes or the like is necessary. Instead, the length adjustment is achieved already by the selection of suitable rope sections. Both rope strings within each section take the load to equal shares.

According to a preferred embodiment of the present invention, all rope sections have identical first ends and identical second ends.

In still another embodiment of the present invention, the set of rope sections comprises rope sections of identical length.

More preferably, the set of rope sections comprises rope sections of a first length and rope sections of a second length, wherein the second length is an integral multiple of the first length. For example, the second length is two time, three times, etc. of the first length.

According to another embodiment of the present invention, one of the first ends or second ends comprise carabiners, and the respective other one of the first ends or second ends comprise plates with engagement holes for receiving the carabiners. For example, if the first ends are equipped with carabiners, the second ends are equipped with the plates with engagement holes, and vice versa. The provision of more than one fastening means (i.e. carabiners or plates with holes) is also a redundant arrangement for taking the load to equal shares.

BRIEF DESCRIPTION OF THE DRAWINGS

These and other objects and advantages of the present invention well be explained in more detail and elucidated with the help of the following drawings, which will be described hereinafter.

DETAILED DESCRIPTION OF THE INVENTION

Figure 1:
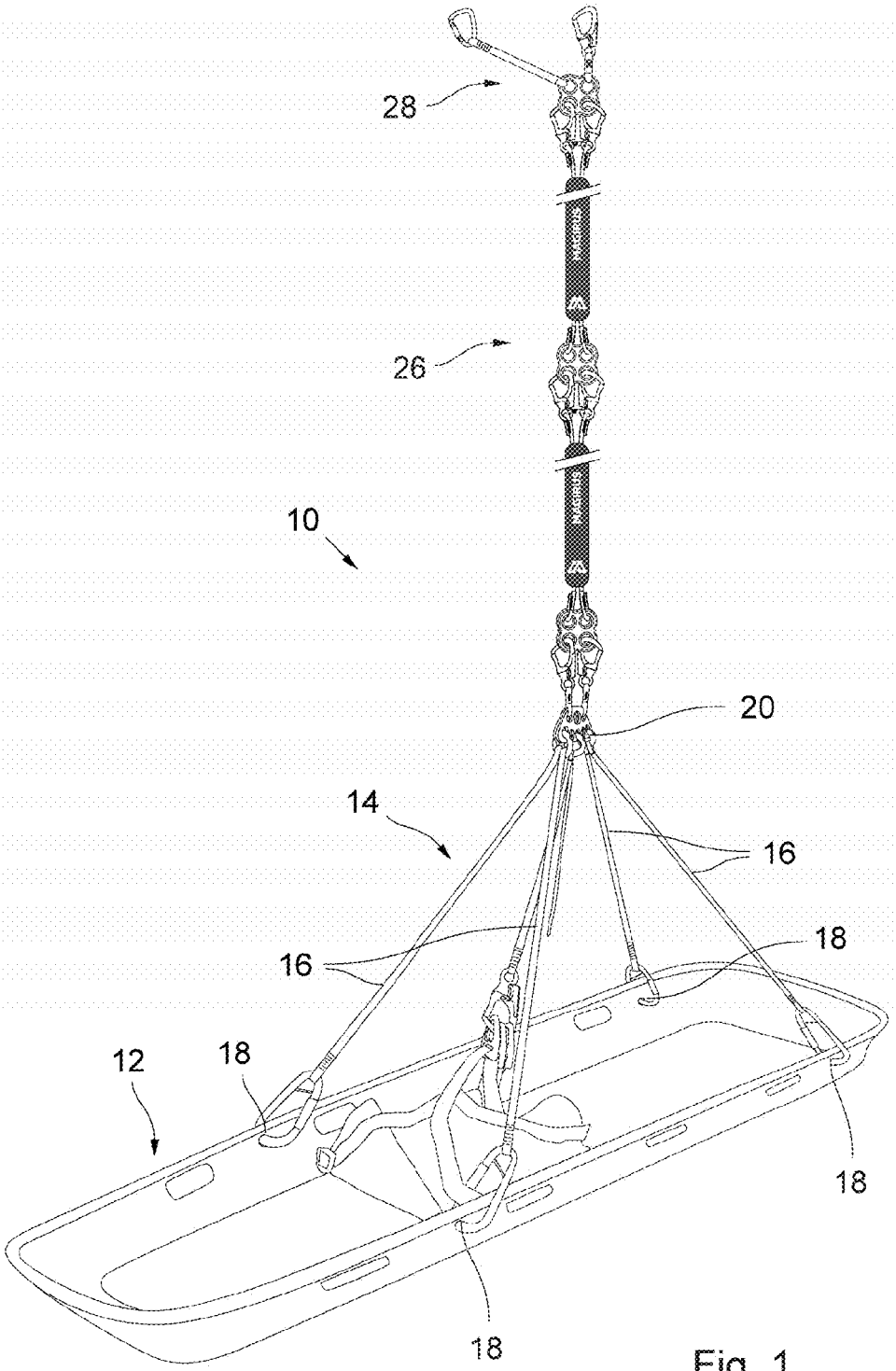
FIG. 1 is a perspective view of an embodiment of a lanyard assembly according to the present invention.

FIG. 1 shows a lanyard assembly 10 for lifting a rescue stretcher 12 that is attached to a lower end of the lanyard assembly 10. The lanyard assembly 10 comprises a lifting gear 14 with four straps 16, with the lower ends of the four straps 16 being fixed at different fastening points 18 of the rim of the stretcher 12. These fastening points 18 comprise engagement holes, into which carabiners at the lower ends of the four straps 16 are engaged. The four straps 16 run together at a top point 20 of the lifting gear, which comprises a plate 22 (better visible in FIG. 2A) with a number of engagement holes 24. In use, as can be taken from FIG. 1, the four straps 16 span a pyramidal space above the stretcher 12. It is noted that the stretcher 12 shown here is just one example of a rescue apparatus for lifting a person to be rescued. The present invention is also applicable to other kinds of receptions for persons, like rescue belt gears or the like.

Figure 3:
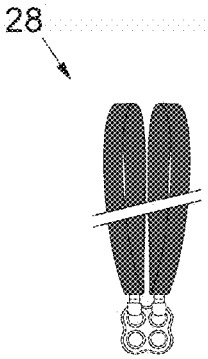
FIGS. 3 and 4 are detailed views of connection elements to be used in the arrangement of FIG. 1.
Figure 4:
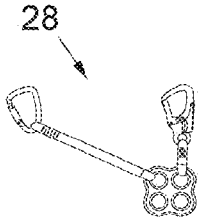

To the upper end of the lifting gear 14, a rope assembly 26 (marked generally by reference 26 in FIG. 1) is attached to connect the lifting gear 14 with a lifting device. The figures only show a connection element 28 of this lifting device, which is a turnable ladder of a fire fighting vehicle or any other kind of aerial rescue apparatus suitable for lifting the lanyard assembly 10 with the stretcher 12. The connection element 28 (shown in more detail in FIGS. 3 and 4) comprises a plate with engagement holes and upper straps for connecting the connection element 28 with other parts of the lifting device. The lifting device as such is not subject of the present invention.

The rope assembly 26 comprises a a plurality of rope sections of different length in the present embodiment that can be connected to each other to form one single rope connection, with its lower end connected to the lifting gear and its upper end connected to the lifting device, as will be explained further in more detail in connection with FIG. 2A to 2D.

Figure 2A:
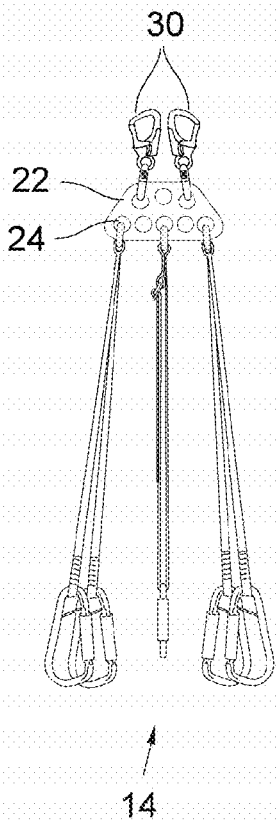
FIG. 2A to 2D are side views of the lanyard assembly of FIG. 1.

FIG. 2A shows only the lifting gear 14, with no rope sections attached. As already described above, the lifting gear 14 comprises a plate 22 with a plurality of engagement holes. In two upper engagement holes 24, carabiners 30 are fixed for connecting the lifting gear 14 to a rope section, as shown in FIG. 2B.

Figure 2B:
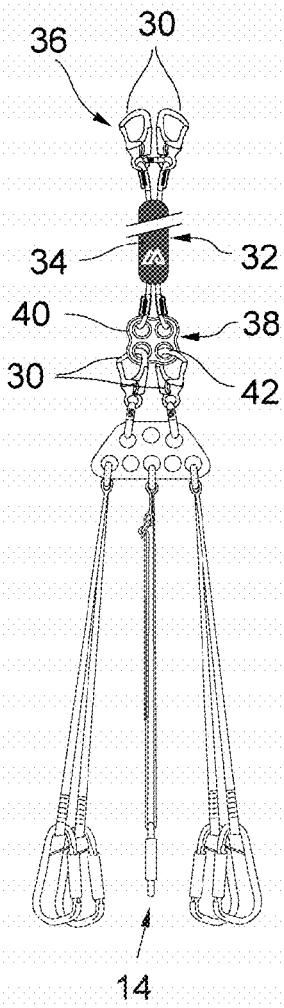

In FIG. 2B, a first rope section 32 is attached to the upper end of the lifting gear 14. The rope section 32 comprises a tunnel-like flat strap 34, which is a woven band of synthetic material or natural fiber. Within this strap 34, two independent rope strings (not shown) run in parallel between the opposite ends of the first rope section 32. The upper end of the first rope section 32 shall be denoted as a first end, while the opposite lower end shall be denoted as second end. At its first end 36, the first rope section 32 comprises two carabiners 30 identical with the carabiners 30 at the upper end of the lifting gear 14.

At its second end 38, the first rope section 32 comprises a plate 40 with engagement holes 42 for receiving the carabiners 30 of the lifting gear 14.

The carabiners 30 are connectable with the connection element 28 of the lifting device, and so are the identical carabiners 30 of the first rope section 32. As a result, the lifting gear can be connected directly to the connection element 28. In a more common way of use, the lifting gear 14 will be connected with the connection element 28 of the lifting device by at least one rope section, as the first rope section 32 of FIG. 2B.

Figure 2C:
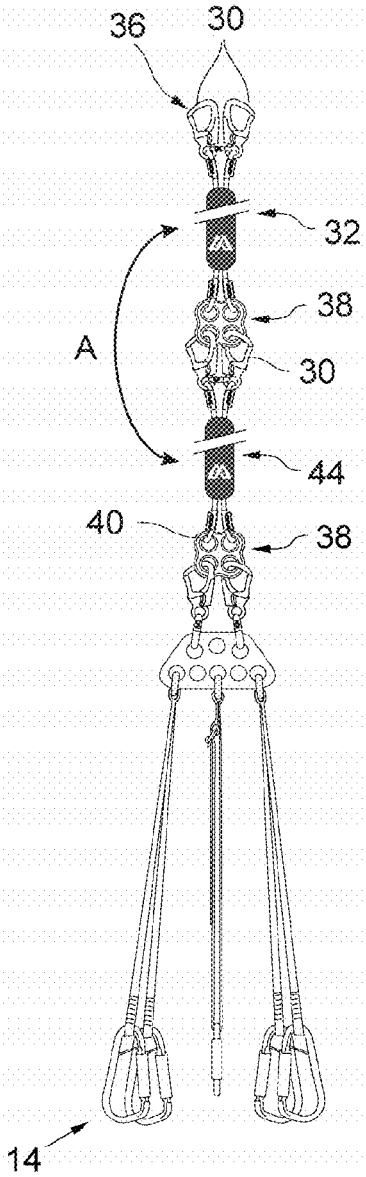

The first rope section 32 shown in FIG. 2B is only one of a set of different rope sections to be selected to connect the lifting gear 14 with the lifting device. In FIG. 2C, the arrangement of FIG. 2B is extended at its upper end by a second rope section 44 that is identical with the first rope section 32. The lower second end 38 of the second rope section 44 is connected to the upper first end 36 of the first rope section 32 by engaging the carabiners 30 of the first end 36 of the first rope section 32 into the engagement holes 42 in the plates 40 of the second end 38 of the second rope section 44. The upper end of the rope assembly formed by the first rope section 32 and second rope section 44 in FIG. 2C is connected by the carabiners 30 of the first end 36 of the second rope section 44 to the connection element 28 (not shown in FIG. 2C).

Considering FIGS. 2B and 2C, the rope connection between the connection element 28 of the lifting device and the lifting gear 14 can easily be extended in its length by connecting one or more additional rope sections of the set to the rope connection. No adjustment mechanism is present within this system, which makes it more fail-safe and saves valuable time in a rescue situation. Both rope strings running within the strap 34 of each rope section 32,44 take the load to equal shares, without any length adjustment necessary. Moreover, as the first rope section 32 and second rope section 44 have the same fixed length, they can be exchanged against one another (indicated by an arrow A in FIG. 2C) and there is no fixed order that must be observed when connecting the different parts. Both first ends 36 of the first rope section 32 and second rope section 44 can both be connected to the connection part 28 of the lifting device. In the same way, the lifting gear 14 can be connected both to the second end 38 of the first rope section 32 and the second end 38 of the second rope section 44.

Figure 2D:
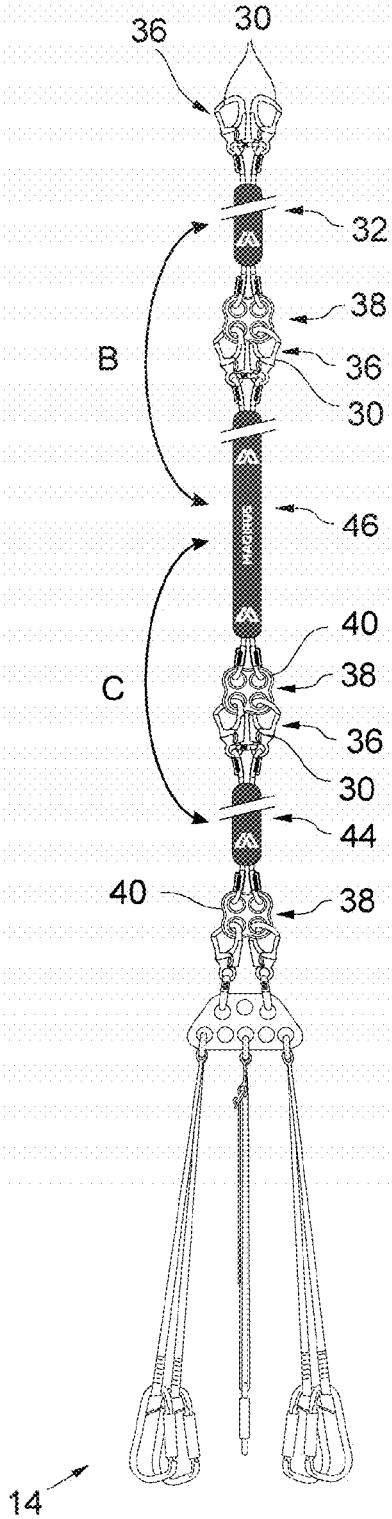

In FIG. 2D, the arrangement of FIG. 2C is further extended by inserting a third rope section 46 between the first rope section 32 and the second rope section 44. The upper end of the third rope section 46 is a first end 36 identical to the first end 36 of the first rope section 32 and second rope section 44, and the lower second end 38 of the third rope section 46 is identical to the second ends 38 to the first rope section 32 and second rope section 44, respectively. In the arrangement of FIG. 2D, the second end 38 of the third rope section 46 is connected to the first end 36 of the first rope section 32, and the first end of the third rope section 46 is connected to the second end of the second rope section 44. The arrangement of first, second and third rope sections 32,44,46 as shown in use in FIG. 2D represents a complete set of rope sections 32,44,46, from which single rope sections can be selected to adapt the length of the connection between the lifting gear 14 and the lifting device. This selection is represented by the first rope section 32 in FIG. 2B and the first and second rope section 32,44 in FIG. 2C.

The third rope section 46 has also a fixed length, which is two times the length of the length of the first and second rope sections 32,44. This difference in length is due to a longer strap 34 of the third rope section 46, connecting its first end 36 and second end 38. As also indicated in FIG. 2D, all rope sections 32,44,46 shown therein are exchangeable against each other, as indicated by arrows B and C, because all of their first end 36 are connectable with all of their second ends 38 and connectable to the lifting device, as well as their opposite second ends 38 being connectable to each first end 36 of each rope sections 32,44,46 or to the lifting gear 14. Forming a rope connection of desired length between the lifting device and the lifting gear 14 is easily performed by selecting rope sections 32,44,46 of desired length from the complete set of rope sections, and connecting them with each other and with the lifting gear 14 and the lifting device, respectively, to result in the arrangement shown in FIG. 2D.

The invention claimed is:

1. A lanyard assembly (10) for lifting a rescue stretcher (12), comprising a lifting gear (14) with fastening means to be fixed at different fastening points of the rescue stretcher, and a rope assembly (26) to connect the lifting gear (14) with a lifting device, characterized in that the rope assembly (26) comprises a set of rope sections (32,44,46) to be connected serially to one another, each rope section (32,44,46) having a fixed length and a first end (36) being connectable to the lifting device and an opposite second end (38) being connectable to the first end (36) of any other rope section (32,44,46) or to the lifting gear (14), and each rope section (32,44,46) comprising at least two rope strings guided in parallel within the respective rope section (32,44,46) between its first end (36) and second end (38), characterized in that the one of the first ends (36) or second ends (38) comprise carabiners (30), and the respective other one of the first ends (36) or second ends (38) comprise plates (40) with engagement holes (42) for receiving the carabiners (30).

2. The lanyard assembly according to claim 1, characterized in that all rope sections (32,44,46) have identical first ends (36) and identical second ends (38).

3. The lanyard assembly according to claim 2, characterized in that the set of rope sections (32,44,46) comprises rope sections (32,44) of identical length.

4. The lanyard assembly according to claim 1, characterized in that the set of rope sections (32,44,46) comprises rope sections (32,44) of a first length and rope sections (46) of a second length, wherein the second length is an integral multiple of the first length.

* * * * *